US006778799B2

(12) United States Patent
Shin et al.

(10) Patent No.: US 6,778,799 B2
(45) Date of Patent: Aug. 17, 2004

(54) LIQUID ELECTROPHOTOGRAPHIC IMAGE FORMING APPARATUS USING NON-VOLATILE INK CARRIER

(75) Inventors: Kyu-cheol Shin, Gyeonggi-do (KR); In-yong Song, Gyeonggi-do (KR); Jeong-hun Pang, Gyeonggi-do (KR)

(73) Assignee: Samsung Electronics Co. Ltd., Suwon-si (KR)

( * ) Notice: Subject to any disclaimer, the term of this patent is extended or adjusted under 35 U.S.C. 154(b) by 0 days.

(21) Appl. No.: 10/246,519

(22) Filed: Sep. 19, 2002

(65) Prior Publication Data

US 2003/0147673 A1 Aug. 7, 2003

(30) Foreign Application Priority Data

Feb. 5, 2002 (KR) ..... 2002-6506

(51) Int. Cl.[7] ..... G03G 15/10; G03G 15/20; G03G 9/00; G03G 9/08

(52) U.S. Cl. ..... 399/237; 399/57; 399/69; 430/116; 430/117

(58) Field of Search ..... 399/57, 69, 233, 399/237, 239, 240, 248, 320, 328, 335; 430/112, 116, 117

(56) References Cited

U.S. PATENT DOCUMENTS 4,004,931 A * 1/1977 Lu ..... 430/117 X
4,024,292 A * 5/1977 Lu et al. ..... 430/112 X
4,059,444 A * 11/1977 Lu et al. ..... 430/112 X
4,268,597 A * 5/1981 Klavan et al. ..... 430/117 X
4,373,469 A * 2/1983 Kuge et al. ..... 430/117 X
5,176,980 A * 1/1993 Santilli et al. ..... 430/116 X
5,240,806 A 8/1993 Tang et al.
5,573,883 A 11/1996 Berkes et al.
6,029,036 A * 2/2000 Itaya et al. ..... 399/239
6,137,976 A * 10/2000 Itaya et al. ..... 399/233
6,167,225 A * 12/2000 Sasaki et al. ..... 399/237
6,173,147 B1 * 1/2001 Nakashima et al. ..... 399/308
6,207,336 B1 * 3/2001 Itaya et al. ..... 430/119
6,219,501 B1 * 4/2001 Zhao et al. ..... 399/57
6,308,034 B1 * 10/2001 Nakashima et al. ..... 399/249
6,311,034 B1 * 10/2001 Nakashima et al. ..... 399/239
6,389,242 B1 * 5/2002 Watanabe ..... 399/237 X
6,466,756 B1 * 10/2002 Nakashima et al. .... 399/237 X
6,571,075 B2 * 5/2003 Nakashima et al. ..... 3399/237
2001/0035352 A1 * 11/2001 Ozerov ..... 204/549

FOREIGN PATENT DOCUMENTS

WO 93/06531 4/1993

* cited by examiner

*Primary Examiner*—Sandra Brase
(74) *Attorney, Agent, or Firm*—Staas & Halsey LLP

(57) ABSTRACT

A liquid electrophotographic image forming apparatus using an ink developing solution having a high concentration where a non-volatile carrier is used as a dispersion solvent includes a photosensitive body, a charge unit increasing a potential of the photosensitive body to a charge potential, an exposure unit projecting a beam onto the photosensitive body and forming a latent electrostatic image, a developing solution supply unit supplying a developing solution to the photosensitive body, the developing solution having a high concentration where a non-volatile carrier is used as a dispersion solvent, a developing unit receiving the developing solution having the high concentration to form a developing film having the high concentration and to develop the latent electrostatic image, a transfer unit contacting the photosensitive body and moving the developed image to a recording medium, and a fixing unit fixing the transferred image in the recording medium at a temperature lower than a flash point of the non-volatile carrier. By using the non-volatile developing solution having the high concentration, a smell generating due to vapor of a carrier can be prevented, and an image forming apparatus having a simple structure can be provided.

34 Claims, 3 Drawing Sheets

LIQUID ELECTROPHOTOGRAPHIC IMAGE FORMING APPARATUS USING NON-VOLATILE INK CARRIER

CROSS-REFERENCE TO RELATED APPLICATIONS

This application claims the benefit of Korean Patent Application No. 2002-6506, filed Feb. 5, 2002, in the Korean Intellectual Property Office, the disclosure of which is incorporated herein by reference.

BACKGROUND OF THE INVENTION

1. Field of the Invention

The present invention relates to a liquid electrophotographic image forming apparatus, and more particularly, to a liquid electrophotographic image forming apparatus using a developing agent in which a non-volatile ink carrier is used as a solvent.

2. Description of the Related Art

FIG. 1 is a cross-sectional view of a conventional liquid electrophotographic image forming apparatus. Referring to FIG. 1, the liquid electrophotographic image forming apparatus includes a photosensitive belt 14, a charger 15 charging the photosensitive belt 14, an eraser 17 erasing a residual charge remaining on the photosensitive belt 14, laser scanning units (LSUs) 16 projecting light onto the charged photosensitive belt 14 and forming a latent electrostatic image, developing units 30 developing the latent electrostatic image, a dryer 18 absorbing and vaporizing a liquid carrier from the photosensitive belt 14, and a transfer unit 20 transferring the developed latent electrostatic image onto paper 23.

The photosensitive belt 14 is circulated by a plurality of rollers including a driving roller 11 and passive rollers 12 and 13. The paper 23 is fed into the transfer unit 20 by rotation of a transfer roller 21 and a fixing roller 22, and the image is transferred onto the paper 23.

The LSU 16 scans data related to colors, such as yellow (Y), cyan (C), magenta (M), and black (K), onto the photosensitive belt 14, and each developing unit 30 supplies a developing solution of a corresponding one of the colors onto the photosensitive belt 14.

The developing unit 30 includes a developing solution supplier 32 supplying a developing solution onto the photosensitive belt 14 and a developing container 31 capturing the developing solution that drops from the photosensitive belt 14. The developing container 31 includes a developing roller 36, a brush roller 37 removing the developing solution that is stained on the developing roller 36, a squeeze roller 34 separating a liquid carrier that does not form images from the developing solution that is supplied onto the photosensitive belt 14, and a plate 35 capturing the liquid carrier that is squeezed out of the squeeze roller 34 into the developing container 31. A collector 39 collects the developing solution.

The developing unit 30 includes the developing roller 36 charged to a predetermined voltage and maintaining a developing gap with the photosensitive belt 14 so that the latent electrostatic images for each color such as Y, C, M, and K, are developed, an injector supplying the developing solution to the developing gap, and the squeeze roller 34 that is placed to apply pressure onto the photosensitive belt 14. The developing solution includes ink having a concentration where a toner, which s transferred onto the paper 23 to form a print image, is dispersed, and the liquid carrier having a low concentration to transfer the toner to a region where the latent electrostatic image of the photosensitive belt 14 is formed.

The liquid carrier used as a solvent and the ink having a developing material representing one of the colors, such as Y, C, M, and K, are supplied from an ink cartridge 38 to the developing solution supplier 32. Thus, the developing solution having a proper concentration, in which the liquid carrier is mixed with the ink, is stored in the developing container 31, and then is supplied to the developing solution supplier 32. The developing solution supplier 32 supplies the developing solution to the photosensitive belt 14.

Since the developing solution having a concentration of 2.5–3% is used in the conventional developing unit 30, the ink having a concentration of 10–30% that is supplied from the ink cartridge 38 is diluted with the liquid carrier having the low concentration and is supplied to the developing unit 30.

In order to supply the developing solution prepared in the developing supplier 32 to a developing nip formed between the developing roller 36 and the photosensitive belt 14, the ink is supplied between the developing roller 36 and the photosensitive belt 14 using the developing solution supplier 32. The developing solution having the low concentration forms the latent electrostatic image on the photosensitive belt 14, and then the photosensitive belt 14 passes the squeeze roller 34 to remove a surplus liquid carrier from the photosensitive belt 14. A residual carrier is absorbed into the dryer 18 and is heated, vaporized, captured and compressed by a condenser, and then removed from the photosensitive belt 14.

The toner having a high concentration and forming an image on the photosensitive belt 14 is transferred to the transfer roller 21 by heat, pressure, or electrostatic force, and part of the residual carrier is vaporized by heat and pressure that is applied to the fixing roller 22 so that the image is retransferred onto the paper 23, and is thus printed out.

The liquid carrier is used in the conventional image forming apparatus as a liquid developing agent to obtain a high quality image. However, since a flash point of the liquid carrier of the developing solution is less than 80° C., when the developed image having the liquid carrier is fixed at a temperature of more than 110° C., the liquid carrier is vaporized, and then the liquid carrier smells. Thus, in order to prevent the smell of the vaporized liquid carrier, a complex vapor capture system supplying and capturing vapor of the vaporized liquid carrier is required, a volume of the image forming apparatus increases, and a structure of the image forming apparatus becomes complicated. An additional cooler is also required for the condensation of the captured liquid carrier.

In addition, in the conventional liquid eletrophotographic forming apparatus, since the concentration of the liquid developing solution is 2–3% and is different from the concentration of 10–30% of the ink that is provided in the ink cartridge 38, a complex ink supply system and a concentration controlling apparatus are required to prepare the developing solution having the concentration of 2–3% by mixing the ink having the high concentration with the liquid carrier. Also, a squeeze process is required to remove the surplus liquid carrier remaining in the liquid developing agent having the low concentration.

SUMMARY OF THE INVENTION

To solve the above and other problems, it is an object of the present invention to provide an image forming apparatus, which is capable of preventing a smell caused by vapor of a carrier and also capable of quickly providing a high quality image.

Additional objects and advantageous of the invention will be set forth in part in the description which follows and, in part, will be obvious from the description, or may be learned by practice of the invention.

Accordingly, to achieve the above and other objects, there is provided a liquid electrophotographic image forming apparatus. The apparatus includes a photosensitive body, a charge unit increasing a potential of the photosensitive body to a charge potential, an exposure unit projecting a beam onto the photosensitive body and forming a latent electrostatic image, a developing solution supply unit supplying the photosensitive body with a developing solution having a high concentration where a non-volatile carrier is used as a dispersion solvent, a developing unit to which the developing solution having the high concentration is supplied to form a developing film having the high concentration and to develop the latent electrostatic image, a transfer unit contacting the photosensitive body and moving the developed image from the photosensitive body to a recording medium, and a fixing unit fixing the transferred image on the recording medium at a temperature lower than a flash point of the non-volatile carrier.

Here, the non-volatile carrier includes perfluocarbons (compounds including fluorine (F) and carbon (C)), silicon oil, vegetable oil, and hydrocarbon and has a relative permittivity and a low surface tension, and the flash point of the non-volatile carrier is higher than 90 C.

According to an aspect of the present invention, the developing solution having the high concentration has a concentration 2–40%, a glass transition temperature (Tg) of more than 30° C., and a melting point (Tm) that is not 20° C. higher than the flash point of the non-volatile carrier.

According to another aspect of the present invention, the apparatus further includes a metering unit forming an ink film having the high concentration.

According to an embodiment of the present invention, using liquid ink (developing solution) where the non-volatile carrier is used as the dispersion solvent, a smell generating due to vapor of a carrier during a printing operation or from a printed matter can be prevented. A fixing energy is reduced by using the developing solution having the high concentration. A dryer or a condenser removing a carrier is not required. Also, a high quality image can be acquired without contamination of a non-image portion during a contacting and developing operation, and a squeeze process of removing a surplus carrier is not required.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
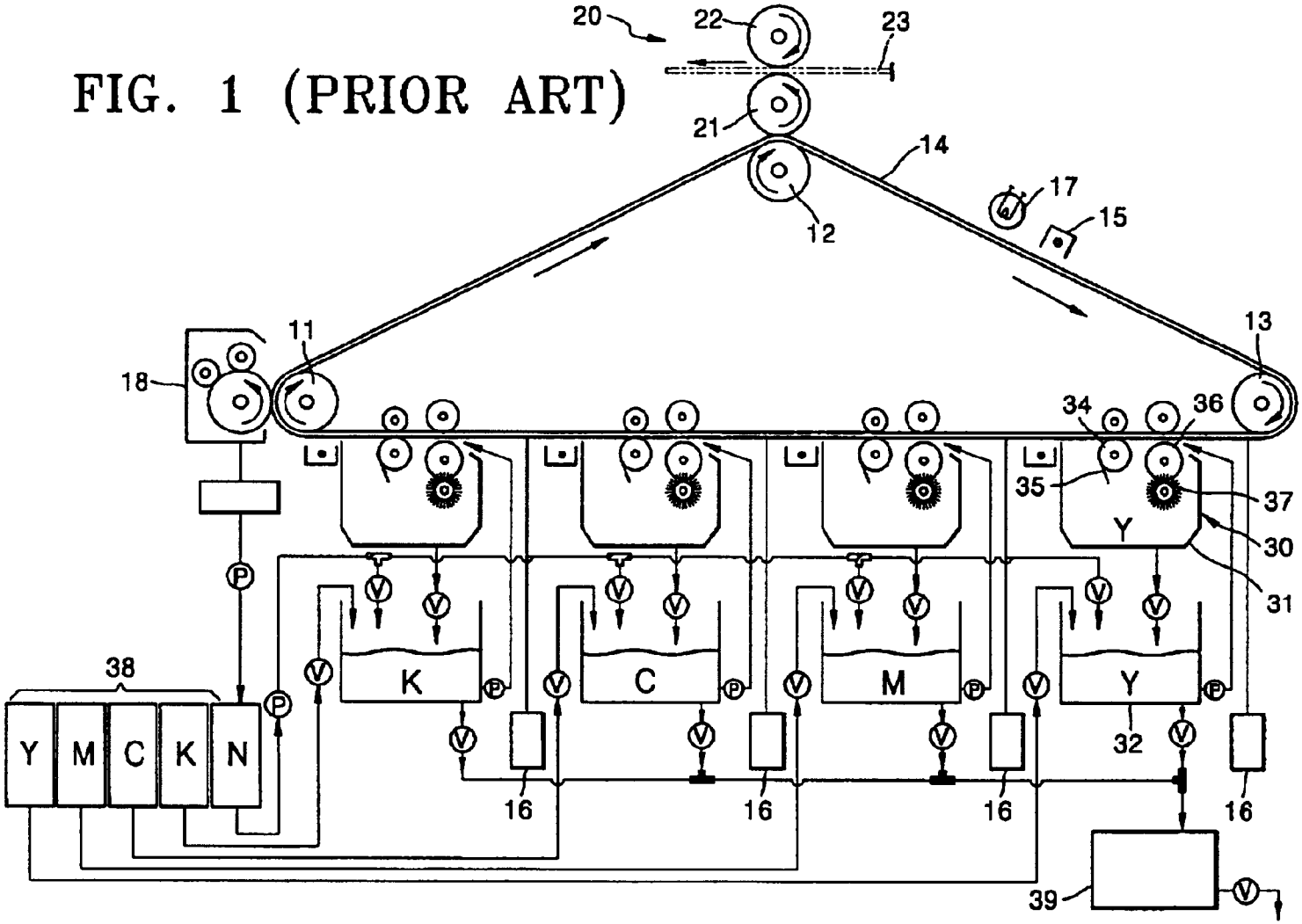
FIG. 1 (PRIOR ART)
FIG. 1 is a schematic diagram of a conventional image forming apparatus.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinafter, embodiments of the present invention will be described in detail with reference to the accompanying drawings. Like reference numerals refer to like elements throughout the drawings.

Figure 2:
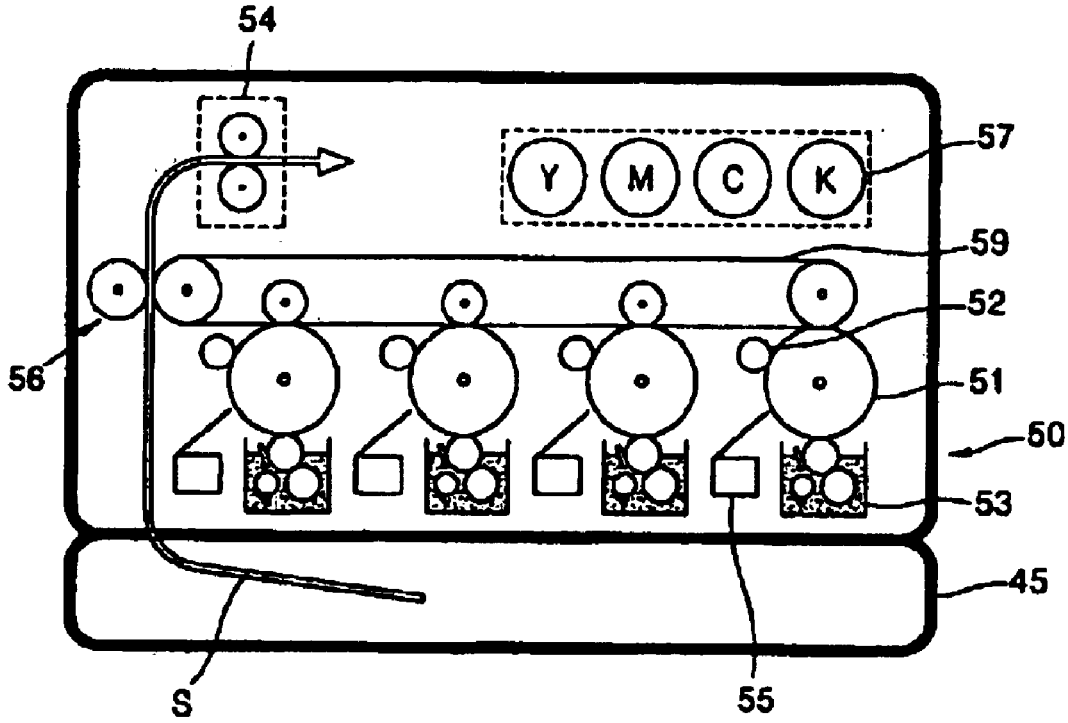
FIG. 2 is a schematic diagram of an image forming apparatus according to an embodiment of the present invention.

FIG. 2 is a schematic diagram of an image forming apparatus according to an embodiment of the present invention. Referring to FIG. 2, the image forming apparatus 50 includes a plurality of photosensitive bodies 51 on which a latent electrostatic image for each color such as Y, C, M, and K, is formed, charge rollers 52 increasing a surface potential of the photosensitive body 51 to a charge potential, exposure units 55 projecting light onto the charged photosensitive body 51 and forming a latent electrostatic image, developing units 53 developing the latent electrostatic image, an intermediate transfer belt (ITB) 59 contacting the photosensitive body 51 and moving the developed image, a transfer roller 56 transferring the image that is moved from the ITB 59 onto paper S supplied from a paper cassette 45, and a fixing unit 54 fixing the transferred image. Here, the ITB 59 and the transfer roller 56 constitute a transfer unit. The image forming apparatus 50 includes an eraser disposed adjacent to corresponding photosensitive body 51 to erase a residual charge remaining on the photosensitive body 51 after the developed image has been transferred to the paper S.

In the image forming apparatus, charge, exposure, and antistatic processes are performed on the photosensitive body 51 having a drum shape in the same manner as performed in a conventional photosensitive belt (such as a photosensitive belt 14 shown in FIG. 1), and a developing solution 68 having a high concentration, where a non-volatile carrier is used as a dispersion solvent, is supplied to the developing unit 53, and thus a squeeze process is not required.

In a case where the surface potential of the photosensitive body 51 is increased to the charge potential by the charge unit 52, the exposure unit 55 scans data related to colors, such as yellow (Y), cyan (C), magenta (M), and black (K), onto the photosensitive body 51 to decrease the charge potential to an exposure potential, thereby forming a latent electrostatic image for each color. Each developing unit 53 supplies the developing solution 68 for each color to the photosensitive body 51 to develop the latent electrostatic image.

Toner of the developing solution 68 on the photosensitive body 51 is moved to the ITB 59 by an electrostatic force, and the toner for each color overlaps with other toner on the photosensitive body 51 and is transferred when passing each developing unit 53.

In a case where an elastic rubber material is used for the ITB 59, a pressure between the photosensitive body 51 and the ITB 59 during a transfer step is about 2~4 kgf, and a transfer voltage between the photosensitive body 51 and the ITB 59 is set to 400–1500V, a transfer characteristic of 90–99% can be achieved. The transfer characteristic depends on a remaining amount of a carrier in the previous operation, and the most proper transfer characteristic can be achieved when the toner has a concentration of about 30–40%. The 90% of the transfer characteristic of the non-volatile carrier means that 90% of the non-volatile carrier of the developing solution remains in the transferred image after a fixing operation.

The fixing unit 54 includes two fixing rollers and fixes the image on the paper S by passing the paper S onto which an image is transferred, through the two fixing rollers. In a case where the fixing rollers are heated at a temperature lower than a flash point of the non-volatile carrier and where a pressure of about 10–30 kgf is applied to the fixing rollers, the vaporization of the non-volatile carrier can be minimized during a fixing operation.

The developing solution 68 where the non-volatile carrier is used as the dispersion solvent, and the developing unit 53 supplying the developing solution 68 to the photosensitive body 51 will be described below with reference to FIG. 3.

Figure 3:
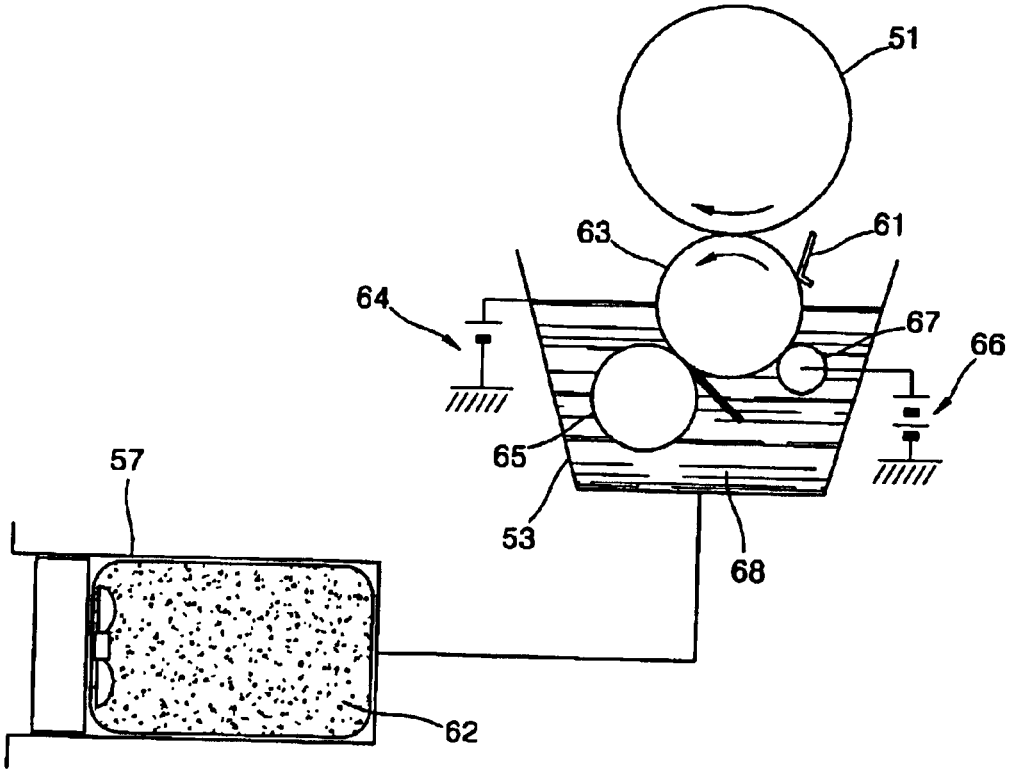
FIG. 3 illustrates a developing unit of the image forming apparatus of FIG. 2.

Referring to FIG. 3, the developing unit 53 of the image forming apparatus includes the developing unit 53 where the developing solution 68 is soaked, a depositing roller 67 soaked in the developing solution 68 in the developing unit 53 and contacting the developing roller 63 or forming a developing gap with the developing roller 63 to supply the developing solution 68 to the developing roller 63, a developing roller 63 having a half portion soaked in the developing solution 68 and rotating in an arrow direction to retain particles of the toner attached by the depositing roller 67, a metering blade 61 applying a predetermined pressure to the developing roller 63 to adjust a thickness of the toner attached to the developing roller 63, and a cleaning roller 65 contacting the developing roller 63 and rotating in a direction to clean the undeveloped toner remaining on the developing roller 63.

The developing unit 53 of the image forming apparatus includes an ink cartridge 57 containing ink 62 having a high concentration, which is a material of the developing solution and is supplied to the developing unit 53, a first power source 66 supplying a predetermined voltage to the deposition roller 67, and a second power source 64 supplying another predetermined voltage to the developing roller 63.

The developing unit 53 is filled with the developing solution 68 having a concentration of about 2–40%. The developing solution 68 is a mixture of the ink 62 having a high concentration and containing the toner and the non-volatile carrier and is a developing agent that is supplied to develop the latent electrostatic image.

The ink 62 having the high concentration is mounted on the ink cartridge 57 according to each color, and the ink cartridge 57 of a piston shape supplies the ink 62 having a high concentration to the developing unit 53 or captures the developing solution 67 in the developing unit 53.

Perfluocarbons (compound including fluorine (F) and carbon (C)), silicon oil, vegetable oil, and hydrocarbon may be used for the non-volatile carrier.

Relative permittivity should a low (smaller than 5) so that the non-volatile carrier acts as the dispersion solvent, a charge director should be well dissolved so as to charge the particles of the ink, and the particles of the ink should be well charged. In addition, viscosity should be low (smaller than 10 cps), and ink mobility should be quick, and a surface tension should be low (smaller than 30 dynes/cm) so that he non-volatile carrier has good developing characteristics. Further, the flash point of higher than 90° C. is required to prevent vaporization of the non-volatile carrier and avoid non-stability occurring due to the vaporization of the non-volatile carrier. In consideration of the requirements, unit prices, and chemical stability, Norpar 15 (normal paraffinic solvent) or Isopar M (a product name of Exxon) (isoparaffinic solvent) may be selected as the non-volatile carrier used in the image forming apparatus according to the embodiment of the present invention.

In a case where Norpar 15 is used for the non-volatile carrier, the flash point is 116° C., a conductivity of the ink is 20–30 pMho/cm, and the ink mobility is $(5\sim8)\times10^{-11}$ ($m^2/V$ s). In order to prevent a clot of the particles of the ink at a room temperature, a glass transition temperature (Tg) of the ink is maintained at higher than 30° C., and a melting point (Tm) of the ink is lower than 130° C. so that a glass transition temperature (Tg) is fixed to be lower than the flash point 116° C. of the non-volatile carrier during the fixing operation.

The photosensitive body 51 is a photosensitive drum coated with an organic photosensitive material and charged by the charge roller 52, which is a conductor. In a case where the charge potential of about 600V is supplied to the photosensitive body 51, the exposure potential may be set to about 50V. In a case where the developing potential that is higher than the exposure potential is supplied to the developing roller 63, and a deposition process is performed, as described above, the latent electrostatic image is formed.

The depositing roller 67 that is soaked in the developing solution 68 contacts the developing roller 63 or forms the predetermined developing gap, that is, is 50–500 $\mu$m apart.

In a case where a developing voltage (i.e., 200–500V) is applied to the developing roller 63, an electrical field is formed between the developing roller 63 and the depositing roller 67, and the toner dispersed in the developing solution 68 is attached to the developing roller 63.

A conductive elastic body is used for the developing roller 63, and the developing roller 63 is formed of polyurethane rubber or nitryl butadiene rubber (NBR). The resistance of the developing roller 63 is about $10^5$–$10^8$ Ω, and the hardness of the developing roller 63 is about Shore A 25–65 degrees, and a surface roughness of the developing roller 63 is about Ra 1–4 $\mu$m. Preferably, the depositing roller 67 is formed of a SUS material of stainless steel.

After the deposition process, a metering process of making a concentration of the image, which is transferred onto the paper S, uniform is performed. In order to keep a constant mass per area (M/A) regardless of the concentration of the developing solution 68 that is widely dispersed on the developing roller 63, a metering blade 61 formed of a proper material should be selected, and proper pressure should be applied to the metering blade 61. Here, the metering blade is a metering unit forming a developing solution film having the high concentration on the photosensitive body 51.

An L-shaped metal plate having a thickness of 0.05–2 mm is suitable for the metering blade 61, and the metering blade 61 is installed to be higher than a water level of the developing solution 68 in the developing unit 53. A metering pressure is about 100–300 gf/cm.

In a case where a pressure, a position, and a shape of a contact portion of the metering blade 61 vary in a state where the metering blade 61 is electrically floated, the M/A is about 20–300 $\mu g/cm^2$, and the concentration (% solid) of the developing solution is about 20–35%. A thickness of a toner layer is determined from a correlation between the pressure applied to the metering blade 61 and an adhesive force of the attached particles of the toner. A uniform M/A on the developing roller can be acquired using the metering blade even when the developing solution 63 having a wider range of the concentration is used rather than the developing solution having a single concentration.

In the image forming apparatus according to the embodiment of the present invention, vapor of a carrier can be prevented by using ink having the high concentration as the developing solution and by using the non-volatile carrier used as the dispersion solvent, thereby removing smell and providing a high quality image without contamination of a non-image portion during a contacting and developing operation.

In the image forming apparatus according to the embodiment of the present invention, a conventional additional unit capturing the vapor of the carrier and condensing the vapor, a complex ink supply unit making the ink having the high concentration into the developing solution having the low concentration, a concentration controlling unit, and a squeeze unit are removed, thereby providing an image forming apparatus having a simple structure. The non-volatile ink having the high concentration is fixed without the above conventional units, thereby reducing fixing energy and forming an image at a high speed.

This invention has been particularly shown and described with reference to a preferred embodiment thereof, but this is not limited to the scope of the invention but should be interpreted as an example of preferred embodiments. In particular, it will be understood by those skilled in the art that a unit constituting the image forming apparatus, such as a developing roller and a metering blade, may be manufactured using a material suitable for use with the developing solution having a high concentration and that changes may be made in this embodiment without departing from the principles and sprit of the invention, the scope of which is defined in the claims and their equivalents.

As described above, the image forming apparatus according to the present invention has the following advantages.

First, by using the non-volatile developing solution having the high concentration, smell of vapor of a carrier can be prevented, and a high quality image can be provided without contamination of a non-image portion.

Second, the dryer removing the carrier, the condenser, and the squeeze unit are not required, thus the structure of the image forming apparatus can be simplified, and by the reduction of the fixing energy, a uniform image can be printed out at a high speed.

What is claimed is:

1. A liquid elect electrophotographic image forming apparatus, the apparatus comprising:

a photosensitive body;

a charge unit charging the photosensitive body to a charge potential;

an exposure unit projecting a beam onto the charged photosensitive body to form a latent electrostatic image;

a developing solution supply unit supplying a developing solution to the photosensitive body, the developing solution having high concentration where a non-volatile carrier is used as a dispersion solvent;

a developing unit receiving the developing solution having the high concentration, forming a developing film having the high concentration, and developing the latent electrostatic image;

a transfer unit contacting the photosensitive body and moving the developed image to a recording medium; and a fixing unit fixing the transfered image in the recording medium at a temperature lower than a flash point of the non-volatile carrier.

2. The apparatus of claim 1, wherein the non-volatile carrier comprises perfluocarbons (compounds including fluorine (F) and carbon (C)), silicon oil, vegetable oil, and hydrocarbon.

3. The apparatus of claim 2, wherein the non-volatile carrier has a relative permittivity and a surface tension of less than 30 dynes/cm.

4. The apparatus of claim 3, wherein the flash point of the non-volatile carrier is higher than 90° C.

5. The apparatus of claim 1, wherein the high concentration of the developing solution is in a range of 2–40% inclusive.

6. The apparatus of claim 5, wherein the developing solution having the high concentration has a glass transition temperature (Tg) higher than 30° C.

7. The apparatus of claim 6, wherein the developing solution having the high concentration has a melting point (Tm) that is not 20° C. higher than the flash point of the non-volatile carrier.

8. The apparatus of claim 1, wherein the apparatus comprises a metering unit forming an ink film having the high concentration.

9. The apparatus of claim 1, wherein the transfer unit comprises:

an intermediate transfer belt contacting the photosensitive body and receiving the developed image from the photosensitive body; and a transfer roller transferring the developed image from the intermediate transfer belt to the recording medium.

10. An image forming apparatus, comprising:

a photosensitive body having a latent electrostatic image;

a developing solution supply unit containing a developing solution having ink and a non-volatile carrier as a dispersion agent;

a developing unit developing the latent electrostatic image with the developing solution;

a transfer unit contacting the photosensitive body to transfer the developed image to a recording medium; and a fixing unit fixing the transferred image on the recording medium at a temperature lower than a flash point of the non-volatile carrier.

11. The apparatus of claim 10, wherein a melting point of the non-volatile carrier is not 20° C. higher than the flash point.

12. The apparatus of claim 10, wherein the transfer unit comprises an intermediate transfer belt receiving the developed image from the photosensitive body and transferring the received developed image to the recording medium.

13. The apparatus of claim 12, wherein a transfer voltage between the photosensitive body and the intermediate transfer belt is between 400 and 1500V.

14. The apparatus of claim 12, wherein a pressure between the intermediate transfer belt and the photosensitive body is between 2 and 4 kgf inclusive.

15. The apparatus of claim 12, wherein the fixing unit comprises fixing rollers heated at a temperature lower than the flash point of the non-volatile carrier and where a pressure between 10 and 30 kgf is applied to the fixing rollers.

16. The apparatus of claim 10, wherein the non-volatile carrier has a permitivity smaller than 5 to act as the dispersion agent.

17. The apparatus of claim 10, wherein the non-volatile carrier has a viscosity smaller than 10 cps.

18. The apparatus of claim 10, wherein the non-volatile carrier has a surface tension smaller than 30 dynes/cm.

19. The apparatus of claim 10, wherein the non-volatile carrier is one of a normal paraffinic solvent and an isoparaffinic solvent.

20. The apparatus of claim 10, wherein the ink of the developing solution has a conductivity between 20 and 30 pMho/cm inclusive.

21. The apparatus of claim 10, wherein the ink of the developing solution has an ink mobility between 5×10−11 and 8×10−11 $m^2/V$ s inclusive.

22. The apparatus of claim 10, wherein the ink of the developing solution has a glass transition temperature higher than 30° C. to prevent a clot of particles of the ink.

23. The apparatus of claim 10, wherein the ink of the developing solution has a melting point lower than 130° C. so that a glass transition temperature of the ink is lower than the flash point of the non-volatile carrier.

24. The apparatus of claim 10, wherein the developing solution has a transfer characteristic being equal or greater than 90%.

25. The apparatus of claim 10, wherein the developing unit comprises a deposit roller and a developing roller transferring the developing solution from the deposit roller to the photosensitive body, and the deposit roller is spaced-apart from the developing roller by a developing gap between 50 and 500 $\mu$m inclusive.

26. The apparatus of claim 25, wherein the developing roller has a resistance of between $10^5$ and $10^8$ Ω inclusive, a hardness of between Shore A 25 and 65 degrees inclusive, and a surface roughness of between Ra 1 and 4 $\mu$m, inclusive.

27. The apparatus of claim 10, wherein the apparatus does not include at least one of a squeezing unit squeezing the developing solution, a dryer drying and vaporizing the non-volatile carrier from the developing solution, and a vapor capturing unit capturing vapor generating from the developing solution during fixing the transferred image.

28. The apparatus of claim 10, wherein the apparatus comprises a metering unit, and mass per area of the metering unit is between 20 and 300 $\mu g/cm^2$ inclusive when the concentration of the developing solution is about 20%.

29. The apparatus of claim 10, wherein the transfer unit comprises an intermediate transfer belt having two opposite longitudinal portions, two opposite round portions disposed between the two opposite longitudinal portions and on respective ones of opposite end portions of the two opposite longitudinal portions in a longitudinal direction, a pair of rotating rollers disposed on respective ones of opposite insides of the two opposite round portions of the intermediate transfer belt to rotate the intermediate transfer belt.

30. The apparatus of claim 29, wherein the two opposite longitudinal portions of the intermediate transfer belt are parallel to each other.

31. The apparatus of claim 29, wherein the two opposite round portions of the intermediate transfer belt are formed by corresponding ones of circumferential surfaces of the rotating rollers.

32. The apparatus of claim 29, wherein the transfer unit comprises a transfer roller disposed opposite to one of the rotating rollers with respect to corresponding one of the two opposite round portions of the intermediate transfer belt to transfer the developed image to the recording medium when the recording medium passes between the transfer roller and the corresponding one of the two opposite round portions of the intermediate transfer belt.

33. The apparatus of claim 32, wherein the two opposite longitudinal portions of the intermediate belt are parallel to an axis passing through centers of the developing rollers.

34. The apparatus of claim 10, wherein the developing unit comprises a plurality of developing rollers disposed adjacent to the photosensitive body.

* * * * *